US009275503B2

(12) United States Patent
Chen et al.

(10) Patent No.: US 9,275,503 B2
(45) Date of Patent: Mar. 1, 2016

(54) METHOD AND APPARATUS FOR REMOTELY COMMUNICATING VEHICLE INFORMATION TO THE CLOUD

(75) Inventors: Yixiang Chen, Palo Alto, CA (US); Drew S. Johnson, San Jose, CA (US); Andrew Durrer, San Jose, CA (US); Michael Garner, Richardson, TX (US)

(73) Assignee: AERIS COMMUNICATIONS, INC., Santa Clara, CA (US)

( * ) Notice: Subject to any disclaimer, the term of this patent is extended or adjusted under 35 U.S.C. 154(b) by 84 days.

(21) Appl. No.: 13/482,825

(22) Filed: May 29, 2012

(65) Prior Publication Data

US 2013/0282227 A1 Oct. 24, 2013

Related U.S. Application Data

(60) Provisional application No. 61/625,850, filed on Apr. 18, 2012.

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/008; G07C 5/0808
See application file for complete search history.

(56) References Cited

U.S. PATENT DOCUMENTS

| | | | | |
|---|---|---|---|---|
| 8,375,412 | B2 * | 2/2013 | Bugenhagen | 725/60 |
| 2010/0256861 | A1 * | 10/2010 | Hodges | 701/33 |
| 2011/0234427 | A1 * | 9/2011 | Ingram et al. | 340/995.1 |

OTHER PUBLICATIONS

HowStuffWorks. "What is a Packet?" HowStuffWorks Mar. 24, 2009.*

* cited by examiner

*Primary Examiner* — John Q Nguyen
*Assistant Examiner* — Michael Kerrigan
(74) *Attorney, Agent, or Firm* — Sawyer Law Group, P.C.

(57) ABSTRACT

The present invention relates generally to the communication of vehicle data, diagnostics and related information with a network remote from the vehicle, and more particularly to communications and storage of vehicle data in the cloud. In one or more preferred embodiments, vehicle information is securely gathered from a vehicle, processed in accordance with instructions and a profile set remotely, and stored at a remote data store, where remote access to such information can be accommodated through applications, smartphones and other remote devices.

39 Claims, 5 Drawing Sheets

200

500

METHOD AND APPARATUS FOR REMOTELY COMMUNICATING VEHICLE INFORMATION TO THE CLOUD

CROSS-REFERENCE TO RELATED APPLICATION

This application claims the benefit of U.S. Provisional Patent Application No. 61/625,850, filed on Apr. 18, 2012, entitled "SYSTEM AND METHOD FOR COLLECTING AND SHARING VEHICLE DATA THROUGH A SERVICE MIDDLEWARE," which is incorporated herein by reference in its entirety.

FIELD OF THE INVENTION

The present invention relates generally to the communication of vehicle data, diagnostics and related information with a network remote from the vehicle, and more particularly to communications and storage of vehicle data in the cloud.

BACKGROUND OF THE INVENTION

On Board Diagnostic (OBD) systems provide a method for vehicles to self-diagnose and report on the diagnosis through readers that are compatible with the OBD protocol. Early OBD systems often illuminated a light or switch to visual report an incident requiring attention or correction. In 1996, the OBD-II standard (an improvement over the original OBD) was mandated as being a required approach and capability for all automobiles sold within the United States.

The OBD-II standard provides for a specific diagnostic connector with pins of a particular orientation (i.e., a standard hardware interface), specific availability of certain electrical signaling protocols (i.e., communication protocols), and a particular messaging format (i.e., report out). FIG. 1 provides a representative view of a OBD-II diagnostic connector 100 and a tethered reader 150 with a display 175. In FIG. 1, the standard interface to be read from is typically a female 16-slot connector 100 (e.g., (2×8) J1962 connector) that provides a communication link from the vehicle (not shown) to a reader 150 having a corresponding male 16-pin connector 155 when the reader connector is attached to the connector. Once attached (the connector 100 and the reader connector 155) the reader 150 is capable to receive signal inputs from the vehicle through the connection 100 and visually present information about the vehicle on a screen 175 of the reader. Typically one of the slots 110 in the connector 100 provides power to the reader (i.e., scan tool or scan device) originating from the battery of the vehicle, although often separate power to the reader is provided for.

Some of the information about the vehicle that is available for display includes vehicle parameters and data from the engine control unit (ECU) and offers an information inside a vehicle, typically in an encoded format. Vehicle parameters that provide information about emissions, oxygen sensor status and conditions, cylinder operations, etc., are some examples. Many vehicle manufacturers have enabled the OBD-II Data Link Connector to be the primary connector in the vehicle through which many systems are diagnosed and programmed. Information concerning such systems is provided for as OBD-II Diagnostic Trouble Codes (DTCs) and are typically 4-digits with an alphabetic prefix of: P for engine and transmission (powertrain), B for body, C for chassis, and U for network. When properly connected and powered, the reader is able to decode the encoded vehicle data for the specific vehicle being evaluated and a diagnosis of vehicle systems and functions can be determined based on received codes.

OBD-II can interface with multiple communication protocols deployed inside a vehicle. There are five protocols used in the OBD-II vehicle diagnostics standard: (1) Society of Automotive Engineers (SAE) J1850 pulse-width modulation (PWM)—a standard of the Ford Motor Company; (2) SAE J1850 variable pulse width (VPW)—a standard of General Motors; (3) International Organization for Standardization (ISO) 9141-2, which is primarily used in Chrysler, European, and Asia vehicles; (4) ISO 14230 Keyword Protocol 2000 (KWP2000); and (5) ISO 15765 Controller Area Network (CAN) bus, where vehicles sold in the US are required to implement CAN as one of their signaling protocols as of 2008.

OBD II has proven to be a standard having widespread utilization in the automobile industry and more recently in adjacent industrial and medical-related markets. However, the application of utilization of OBD II remains limited to localized methods of display and communications. For instance, the tethered communication arrangement of FIG. 1 proves to be inconvenient in accessing and storing the acquired data from the tethered reader. Other applications of OBD II are known to include the application of additional communication methods including universal serial bus (USB) communication linkages to local personal computers (PCs) adapted with the 16-pin connectors or Bluetooth® arrangements for nearby communications with PC devices (Bluetooth is a trademark of Bluetooth SIG, Inc.). Still others may involve the further implementation of customized protocols which provide to be uneconomical or unable to provide adequate flexibility in communications.

However, what is desired is the ability to extract vehicle diagnostics and related information from vehicles and equipment using one or more existing OBD II communications protocols while being able to link and store the acquired diagnostic and information in the cloud, via cloud computing, for further utilization.

As used herein the terms mobile device, third party system, smart phone, terminal, remote device, wireless asset, etc. are intended to be inclusive, interchangeable, and/or synonymous with one another and other similar communication-based equipment for purposes of the present invention though one will recognize that functionally each may have unique characteristics, functions and/or operations which may be specific to its individual capabilities and/or deployment.

As used herein the term cloud is intended to include a computing infrastructure that provides for entrusted services with data, software and computation over a network, where such a network is not constrained to be necessarily localized or of a particular configuration. The term cloud includes networks and network arrangements, such as the Internet, which provide for cloud computing capability.

As used herein the term cloud computing is understood to include methods of utilizing various connected computing devices, servers, clusters of servers, wired and/or wirelessly, which provide a networked infrastructure to deliver computing, processing and storage capacity as services where a user typically accesses cloud-based applications through a web browser, mobile application (i.e., app) or similar while the primary software and data are stored on servers of the cloud network at a remote location. Devices capable of providing computer processing capabilities (i.e, servers, PCs, computers, processors, etc.) are intended to be used interchangeably herein.

SUMMARY OF THE INVENTION

The present invention fulfills these needs and has been developed in response to the present state of the art, and in particular, in response to the problems and needs in the art that have not yet been fully solved by currently available technologies.

One embodiment of the present invention includes a method for communicating and storing vehicle information from a vehicle across a remote network to one or more remote devices utilizing at least one communication protocol of the vehicle. The method includes the steps of: receiving vehicle data from the vehicle through a device protocol system in communication arrangement with the vehicle; transmitting at least one message having a device ID, an endpoint ID, and the received vehicle data, from the device protocol system across the remote network to a service broker system capable of mapping the device ID and the endpoint ID; and, decoding and storing the vehicle information of the at least one transmitted message on the remote network at a data store in relation to the transmitted at least one message.

Another embodiment of the present invention includes an apparatus for communicating and storing vehicle information from a vehicle across a remote network to one or more remote devices utilizing at least one communication protocol of the vehicle, comprising: a device protocol system capable of communications with a remote service broker system and a vehicle, the device protocol system having: a protocol adapter for communicating with a vehicle communication system of the vehicle across one or more defined protocols and receiving vehicle data, and a device controller for communicating received vehicle data and one or more network storage addresses with a service broker system across the remote network, the service broker system having: a broker network module for receiving and sending one or more messages with one or more of the device controller, a device maker, a vehicle manufacturer, a vehicle assignee, a data store, and a mobile application; a decoder for decoding received vehicle data from the device protocol system; and an access control module for providing a data use profile rule set for the vehicle data; whereby the service broker system stores decoded vehicle data to the one or more remote devices across the remote network in relation to the one or more remote network storage addresses.

A further embodiment of the present invention includes a computer program product stored on a computer usable medium, comprising: computer readable program means for causing a computer to control an execution of an application to perform a method for communicating and storing vehicle information from a vehicle across a remote network to one or more remote devices utilizing at least one communication protocol of the vehicle, comprising the steps of: receiving vehicle data from the vehicle through a device protocol system in communication arrangement with the vehicle; transmitting at least one message having a device ID, an endpoint ID, and the received vehicle data, from the device protocol system across the remote network to a service broker system capable of mapping the device ID and the endpoint ID; and, decoding and storing the vehicle information of the at least one transmitted message on the remote network at a data store in relation to the transmitted at least one message.

DETAILED DESCRIPTION OF PREFERRED EMBODIMENTS

The present invention relates generally to the communication of vehicle data, diagnostics and related information with a network remote from the vehicle, and more particularly to communications and storage of vehicle data in the cloud.

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 2:
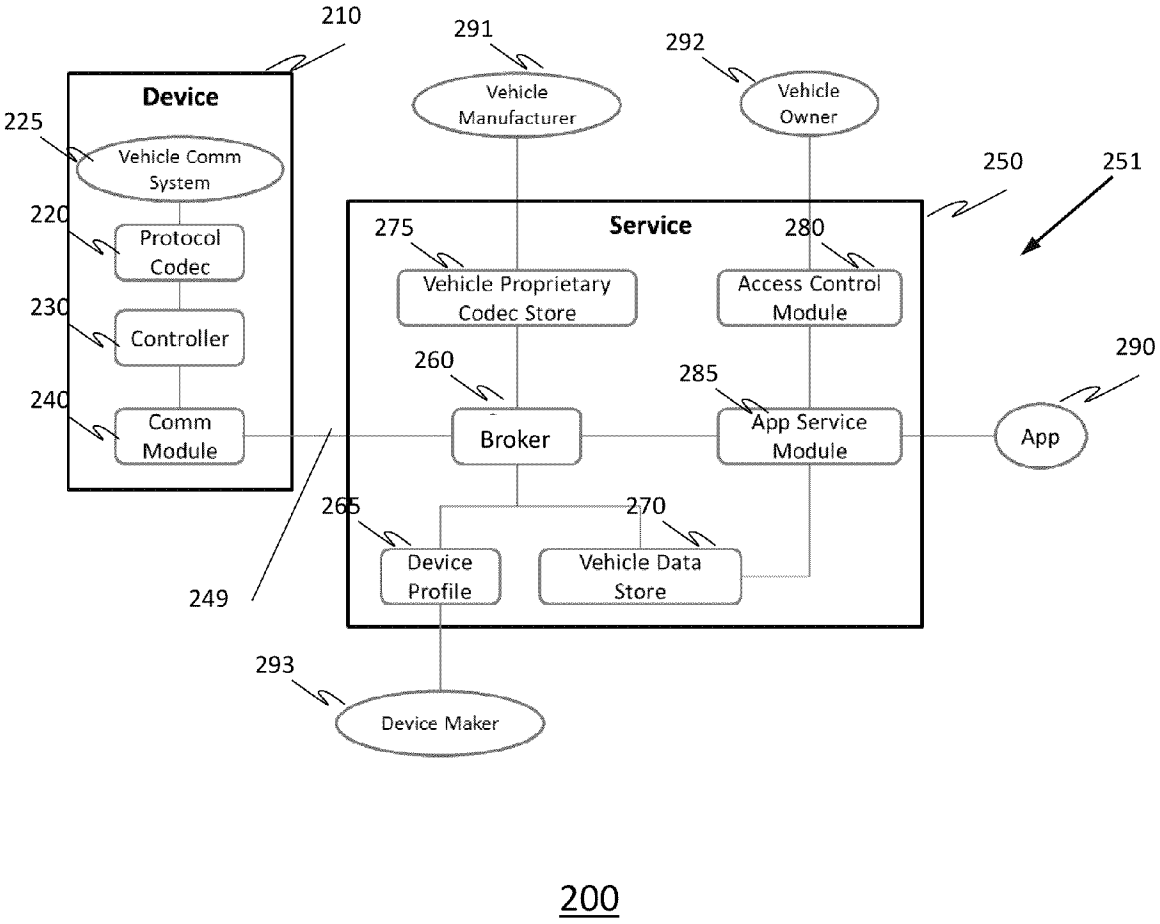
FIG. 2 illustrates a diagram of the present invention in accordance with one or more embodiments.

FIG. 2 illustrates a diagram 200 of the present invention in accordance with one or more embodiments. From FIG. 2, the present invention comprises two primary system functions: a device protocol system (DPS) 210, or device, for interfacing with a vehicle having vehicle data; and a service broker system (SBS) 250, which typically resides remote from the DPS, for communicating with the DPS and with other nodes, addresses and parties a part of the remote network (i.e., vehicle manufacturer, vehicle owner, device maker, application, etc.).

Figure 1:
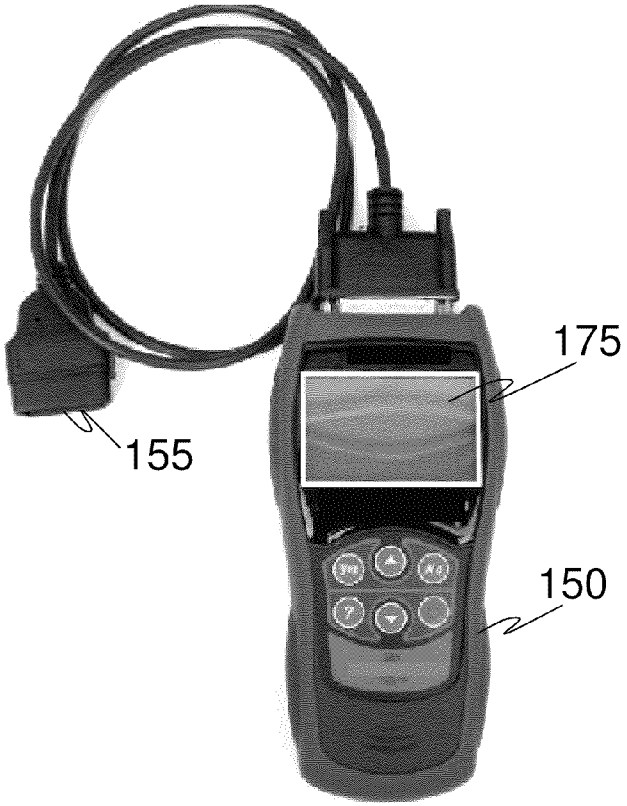
Figure 1 Prior Art
FIG. 1 provides a representative view of an OBD-II diagnostic connector and a tethered reader with a display.
Figure 1:
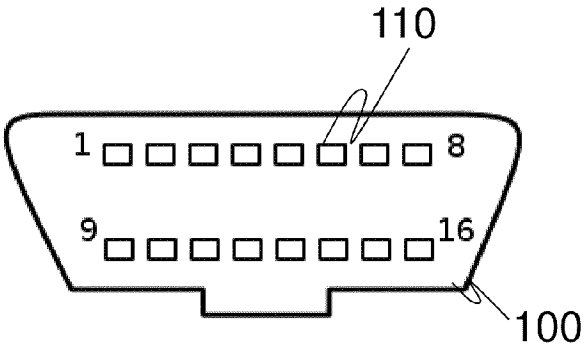
Figure 1 Prior Art

From FIG. 2, the DPS 210 has a device identifier (ID) and includes a device protocol adapter (i.e., device adapter) 220, for interfacing with the vehicle communication system (VCS) of the vehicle 225; a device controller 230, for managing data requests, transmission frequency, event triggers, etc.; and a device communications module 240, for transmitting vehicle data over a remote network 249 to the SBS 250 residing on a network remote 251 from the vehicle and DPS. The VCS 225 is not part of the DPS 210 but is arranged to be in operative communication typically by "plugging in" using conforming connectors, such as those of standardized OBD II connectors of FIG. 1 (16-slot connector J1962 connector) by example.

In one or more preferred embodiments, the device controller also provides support for controlling vehicle diagnostics and reporting from the SBS. Preferably, the controller communicates using a unique protocol to communicate with the SBS Broker component 260 (discussed later and also as a communication server) although the unique protocol is not essential to the present invention. Communication between the DPS and the SBS, across a network 249, is typically handled through the communication linkage between DPS' device controller 230, the device communication module 240, and the SBS' Broker 260, where the communication linkage can be over a variety of communication architectures, methods, and networks, including but not limited to: Code division multiple access (CDMA), Global System for Mobile Communications (GSM) ("GSM" is a trademark of the GSM Association), Universal Mobile Telecommunications System (UMTS), Long Term Evolution (LTE), 4G LTE, wireless local area network (WIFI), and one or more wired networks. Messages containing information related to commands, vehicle data, service data and proprietary data are passed between the DPS and the SBS across networks 249.

The DPS' device controller, in one or more preferred embodiments may be a circuit board, a control device, software, firmware, or an Arduino board that interfaces with the DPS communication module.

In one or more preferred embodiments, the device communication module 240 provides for transmitting vehicle data over a remote network 251 to the SBS 250. Preferably, the module has a unique identifier (ID) associated with it whereby it may provide an endpoint or network ID that uniquely identifies the communication endpoint in the remote network. An example of an endpoint ID is that of a Mobile Identification Network (MIN), Internet Protocol (IP) v4/IPv6 address and similar.

Vehicle data that is available from the vehicle across the VCS may include any of diagnostic, operational, performance, proprietary, service, and parameter data. The VCS is preferably electronic and in communication arrangement with the engine control unit (ECU) or engine control module (ECM), used interchangeably herein, as well as the DPS to provide current and historical information to the present invention. Preferably, the vehicle data may be communicated across the device protocol system using one or more defined protocols, and which are further preferably compliant with OBD II. Preferential protocols include those that are OBD II compatible including: (1) SAE J1850 PWM; (2) SAE J1850 VPW; (3) ISO 9141-2; (4) ISO 14230 KWP2000; and (5) ISO 15765 CAN bus (referenced herein as "defined protocols").

Further from FIG. 2, is the SBS 250 which is the "service" side of the present invention. The SBS includes: a broker 260, for receiving and sending messages to the device controller 230 via the device communication module 240; a device profile 265, for storing mappings between endpoint or network IDs and Device IDs; a vehicle data store 270, for managing storage and indexing of vehicle data received by the Broker 260; a vehicle proprietary codec store 275, for storing vendor proprietary codecs, where a device maker can store their own codecs if desired thereby protecting their formats and commands as needed; an access control module 280, for providing security, permission and privacy in relation to the obtained or to-be-obtained vehicle data; an application (app) service module 285, for processing requests from applications 290 to access vehicle data; and various interfaces which may be locally or remotely situated in relation to the SBS 250 to provide or request specific information. These interfaces may include, by example: application interface 290, vehicle manufacturer interface 291, vehicle owner interface 292, device maker interface 293; however the present invention is not so limited and is able to be configured to be in communication with other nodes, sources, information and data points provided such points are accessible over the network.

In one or more preferred embodiments, the broker 260 is situated as network middleware that is responsible for receiving and sending messages to the device controller 230. The broker 260 is also responsible for managing triggers or "conditions" that would trigger vehicle data to be sent to an App or Apps 290. For example, an Application 290 may have commands indicating it is to receive vehicle data only when a vehicle speed approaches eighty miles per hour. The broker 260 also maintains a mapping between the Device ID and the Network ID (or endpoint ID).

By the broker maintaining the mapping, an Application may address the device by Device ID only thereby enabling device mobility across different networks that may require different Network IDs. It will be appreciated by those skilled in the art that a Network ID can change for various reasons, where, for example, a MIN may change if the device owner switches to a new network service provider. Similarly, the IP address may change if the device is moved to a different local network. However, by further example, a device ID such as VIN is typically bound to the life time of the device. Therefore, as in the present invention, by decoupling Device ID from Network ID, service portability and mobility to Applications is also provided for.

In one or more further preferred embodiments, the broker 260 will query the device profile 265 upon the receipt of a message from the App service module 285 that is addressed to a device 210. The query will be an attempt to find a communications module network ID for the device that is being addressed.

Similarly, in one or more further preferred embodiments, when the broker 260 receives a message from the device, it will decode the message and store it in the vehicle data store 270. The broker 260 will also then check to determine if there is a pending request from an Application 290 waiting for the message. If there is a pending request, the communication server aspect of the broker 260 will send the data to the Application 290 through the App service module 285.

In one or more further preferred embodiments, the device profile 265 may further contain other information about the device such as vendor, manufacturing date and etc.; and, the vehicle data store 270 may, to improve data retrieval times, partition vehicle data by reporting time intervals and Vehicle Identification Number (VIN) and by indexing each measurement by the values in a data collection.

In further preferred embodiments, the access control module 280 provides for enabling vehicle owners (or vehicle assignees such as a repair shop or authorized other under control of the vehicle) to control how their vehicle data will be shared. Preferably, an owner can set up a data sharing profile (i.e., user profile) with identifiable attributes, such as: VIN, User ID (the entity that will receive and use the data), Authentication and Authorization rules (whether authentication and authorization from the user is required and the type of authentication and authorization), duration (sharing start time and duration), etc. The profile is then stored in the access control module 280.

In further preferred embodiments, the App service module 290, in providing for processing requests from applications to access vehicle data, may encounter that many applications may request the same vehicle data. In response, the App service module may implement data caching to speed up processing times. Operationally, when the App service module receives a request from an app 290 to access data from a vehicle, it communicates with the access control module 280 to determine if this request has been authorized by the vehicle owner. If the owner has not authorized the data access, the module will reject the request from the app.

Typically, in the present invention, the App service module 290 provides two types of data service to Applications. One type of service is to retrieve historical data records from a vehicle. The other service is to retrieve the current vehicle data, where the current vehicle data may be further divided into: (a) One time single request and (b) Tracking request (based on time or geographical area). Historical data can be serviced from the vehicle data store 270. If the request is for "current" data, the App service module will communicate with the broker 260 to send the "current" request to the device 210.

In the present invention, a typical message that may be passed between the DPS and the SBS includes three primary portions: a header, service data and proprietary data.

The header preferably includes the length of message or any message structure information to aid in the decoding of the message. The header includes a Network ID that uniquely identifies the communication module 240 of the device 210 that is sending/receiving the message. The header can also include an identifier to uniquely identify the device sending or receiving the message. The device ID can be a VIN, for example. The header can include a session identifier if the message is sent as part of a communication session between the DPS and SBS and multiple messages may be provided during a single session.

The service data portion preferably includes vehicle data and commands. The proprietary data portion preferably includes proprietary data that may require third party codec(s).

Operationally, the present invention, in one endeavor, has been prototyped using a CAN controller to extract vehicle diagnostics from a test vehicle via an OBD II connector. It will be appreciated that a microcontroller that interfaces with the CAN bus to decode/encode CAN parameters can be implemented while also interfacing with the Controller using RS-232 over a serial port. The CAN bus is a message-based vehicle bus standard protocol designed to allow microcontrollers and devices to communicate with each other within a vehicle without a host computer. It will also be recognized that the CAN bus though originally designed for automotive applications, is also suitable and used in various other industries including industrial automation and medical equipment applications. The table below shows a single example of various information that the present invention can collect and export through the OBDII connector, though it should be understood that the present invention is not limited to that represented in the table below:

| Category | Measurement |
|---|---|
| Vehicle | VIN |
| | Vehicle speed |
| | Ambient air temperature |
| | Run-time since engine starts |
| Engine | Engine load |
| | Engine coolant temperature |
| | Engine RPM |
| | Throttle position |
| | Accelerator pedal position |
| | Air flow rate |
| | Engine oil temperature |
| | Engine torque |
| Fuel | Short and long term fuel % |
| | Fuel system status |
| | Fuel pressure |
| | Fuel level input |
| | Fuel type |
| | Ethanol fuel % |
| Hybrid | Hybrid battery pack remaining life |

Figure 3:
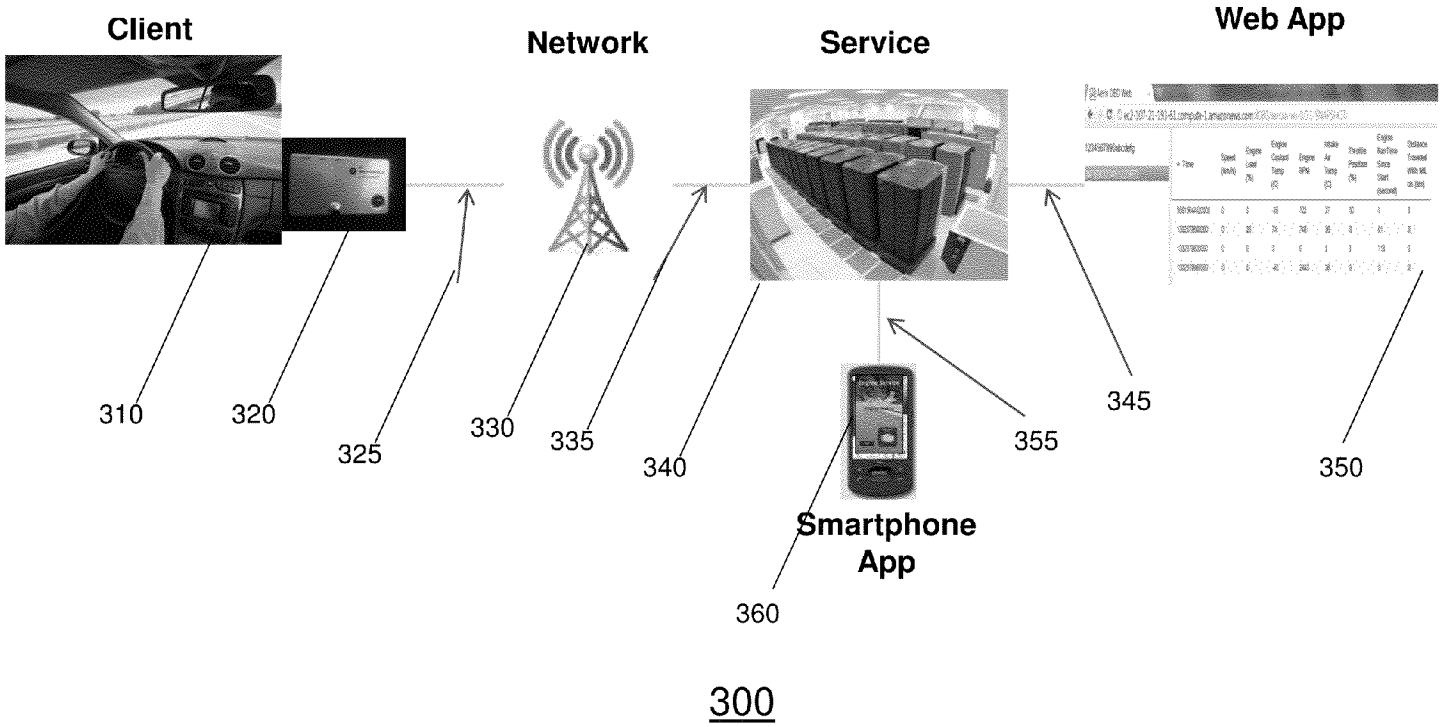
FIG. 3 illustrates a functional information flow of the present invention in accordance with one or more embodiments.

FIG. 3 illustrates a functional information flow 300 of the present invention in accordance with one or more embodiments. From FIG. 3, a vehicle, having an electronic VCS is depicted at 310. The VCS is in communication with a DPS of the present invention at 320. The DPS is able to communicate with the VCS and obtain vehicle information and data across a communication link in bilateral communication. Data received by the DPS from the VCS can then be passed across a network 330 using a communication protocol at 325 and 335. Preferably, the communication protocol at 325 and 335 is a protocol or standard that is cooperative with the OBD II standard, where such a protocol may be a custom protocol, an existing protocol, or a hybrid. In one or more embodiments, the protocol at 325 and 335 is based on a CAN bus standard.

Data and message traffic is passed bilaterally, depending on the push or pull of the system, across the network 330. Messages that are passed from the client or device side 310 across the network 330 to the SBS at 340, are received by the SBS (or service side) for processing. In one or more preferred embodiments, the SBS is a service-based activity which based on at least one and preferably a cluster of servers at a location remote from the device. The SBS is able to accommodate the receipt, decoding, encoding, storage, and connectivity for communications with other interfaces in accordance with the requisite commands of the message content and/or associate data owner (i.e., client, owner of device, or owner of vehicle).

Preferably vehicle data received and processed at the SBS is then available for access and utilization via a web-based application or server site in the cloud at 350. Communication of the post-SBS processed vehicle data is passed to the cloud via a web or http protocol/standard at 345 and is preferably encrypted. Similarly, data post-SBS processed is also available via communication device 360 via the appropriate application protocol across a web or http protocol/standard at 355.

Data and message traffic that is provided from a smartphone application 360 or via a web browser 350 is passed to the SBS 340 for processing over a common standard at 345 or 355. The SBS then refers the commands and formats, as instructed or in accordance with a rule-based instruction in relation to a client's user profile (e.g., security, access, encryption, etc.), across the network 330 to the DPS 310. The appropriate DPS 310 is identified by its device ID or instruction, discussed previously.

It will be appreciated by those skilled in the art that there are a variety of implementations of the present invention and the inclusion of technologies, such as protocols and communication standards, which also will enable the present invention to perform as designed.

Figure 4:
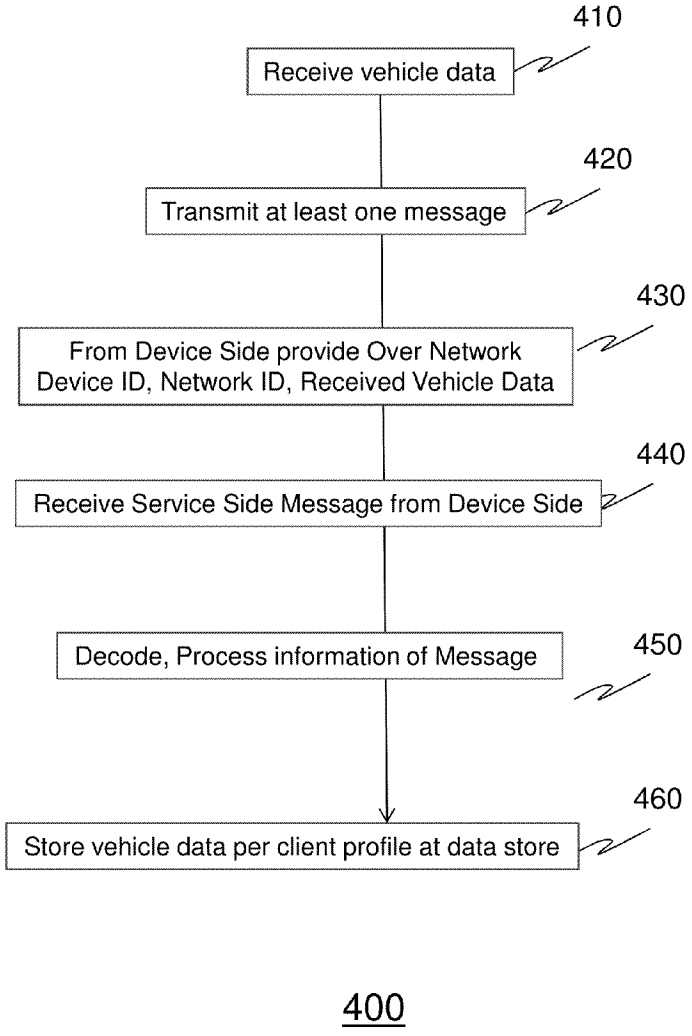
FIG. 4 depicts a processing flow of the present invention in accordance with one or more embodiments, where vehicle data is stored remotely after acquisition from a vehicle across a remote network.

FIG. 4 depicts a processing flow 400 of the present invention in accordance with one or more embodiments, where vehicle data is stored remotely after acquisition from a vehicle across a remote network. From FIG. 4, the communicating and storing of vehicle information from a vehicle across a remote network to one or more remote devices utilizing at least one communication protocol of the vehicle is provided. At 410, vehicle data from the vehicle, via its VCS, is received at a device protocol system in communication arrangement with the vehicle on the device-side or DPS. Preferably, DPS and the VCS are capable of communication across a predetermined protocol. The DPS prepares the received vehicle data with additional information identifying preferably the device ID and the network ID, into a predetermined message format for transmission at 420. Preferably, at least one message is processed and has a device ID, an endpoint ID, and the received vehicle data, where the SBS is capable of mapping the device ID and the endpoint ID. Preferably the endpoint ID may include one or more of a mobile identification network (MIN) identifier, an Internet Protocol (IP) v4 address, an IPv6 address, a device IP address, an address of a user, an address of a vehicle manufacturer, and/or an address of a storage device. Preferably, the message may further include service information, proprietary information and similar. The DPS then sends the message from the device-side to the SBS, or service-side, across a network at 430.

The SBS receives the transmitted message at 440 and processes in accordance with the instructions, user profile, or other command information at 450. The SBS may communicate with applications, external interfaces, vehicle manufacturers, vehicle owners, diagnostic systems, mobile applications, mobile devices, and device protocol systems, etc. depending on the instructions or needs for processing. The SBS will also store the received and decoded vehicle data at a data store in accordance with the rule set of the client profile or other instruction at 460.

Preferably, the data store is located at an address on the remote network associated with an endpoint ID and a network ID. In one or more preferred embodiments, the SBS further includes: a device profile module for storing the mapping of the device ID and the endpoint ID to one or more addresses on the remote network, whereby a device ID includes at least one endpoint ID; a data store being at least one of the one or more remote devices for storing received vehicle data; and, an applications service module for processing requests from software applications to access vehicle data.

Figure 5:
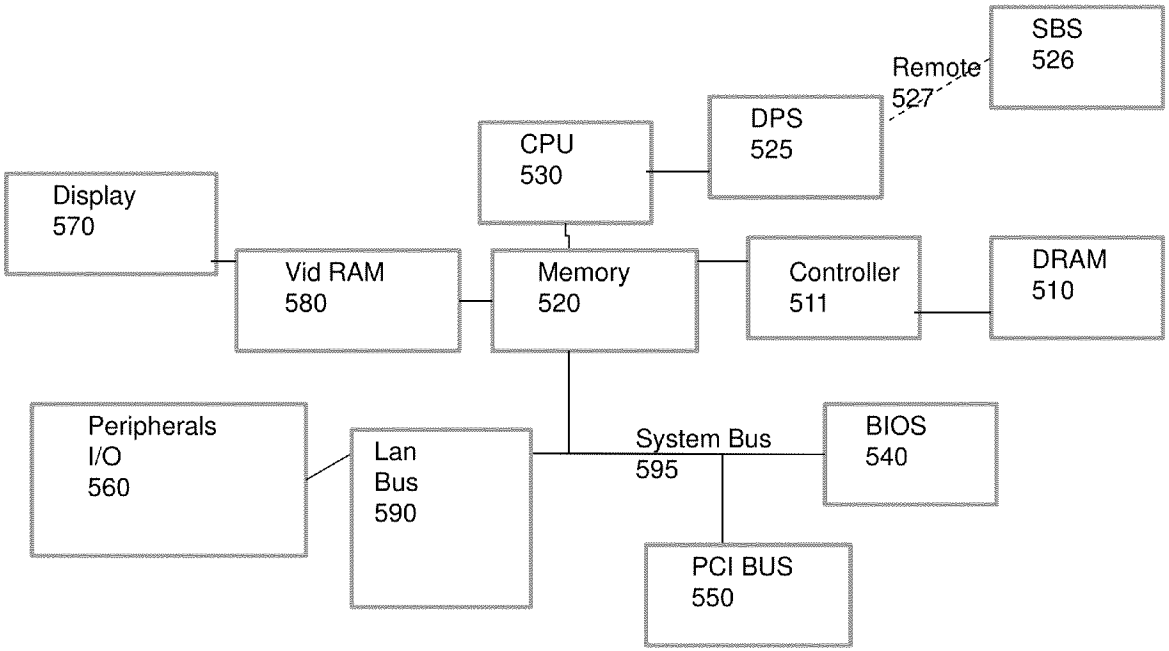
FIG. 5 is a block diagram of a computer with a device side in communication with a service side using the present invention.

FIG. 5 is a block diagram 500 of a computer with a device side in communication with a service side using the present invention. FIG. 5 depicts a personal computer (PC) orientation using the present invention, in which a central processing unit 530, memory 520, memory controller 511 with logic, and DRAM 510 are operably arranged to communicate with one another to perform commands and transactions in association with a DPS 525. Also present is a video RAM memory 580 with a display 570 connection, peripherals and input/output devices 560 connected with a LAN Bus 590, BIOS 540, PCI BUS 550 and system bus 595. The logic of the memory controller is programmable and preferably has an application to provide logic to operate the PC using the present invention. The logic is able to perform the processing operation of the present invention, in accordance for instance with FIG. 2, and then provide commands using define protocols and preferred protocols across one or more remote networks as previously set forth. The DPS and the SBS 526 communicate over a remote network 527 using a preferred protocol. The PC is one example of an implementation of the present invention, though the present invention may be used or implemented in a variety of forms such as software, firmware, hardware, application, web-based operation, or any combination thereof.

It will be appreciated by those skilled in the art that the term ECU may also be used interchangeably with the term or equivalent of powertrain control module (PCM) which is typically referenced to be a electronic control unit capable of controlling a series of actuators on an internal combustion engine to ensure the optimum operation.

As used herein, the term vehicle in one or more embodiments may include automobile, mobile transport equipment, industrial equipment, medical device, or device having a communication system, ECU, or similar, to provide data across a communication protocol.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims. Many other embodiments of the present invention are also envisioned.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

What is claimed is:

1. A method for communicating and storing vehicle information from a vehicle across a remote network to one or more remote devices utilizing at least one communication protocol of the vehicle, comprising the steps of:

receiving vehicle data from the vehicle through a device protocol system in communication arrangement with the vehicle;

providing security, permission and privacy in relation to the vehicle data;

processing requests from applications to access the vehicle data;

providing a data sharing profile which includes identifiable attributes, authentication and authorization rules and duration, to an entity in control of the vehicle to allow for control of how data of the vehicle will be shared;

transmitting at least one message having a device ID, a network ID, and the received vehicle data, from the device protocol system across the remote network to a service broker system capable of mapping the device ID to the network ID; wherein the network ID uniquely identifies a communication endpoint in the remote network; and, decoding and storing the vehicle information of the at least one transmitted message on the remote network at a data store in relation to the transmitted at least one message.

2. The method of claim 1, wherein the received vehicle data from the vehicle is one or more of diagnostic, operational, performance, proprietary, service, and parameter data.

3. The method of claim 2, wherein the vehicle further comprises an electronic vehicle communication system in communication arrangement with the device protocol system using one or more defined protocols.

4. The method of claim 3, wherein the device protocol system and the vehicle communication system are in communication via one or more defined protocols.

5. The method of claim 3, wherein the service broker system is in communication with one or more of a vehicle manufacturer, vehicle owner, diagnostic system, mobile application and device protocol system.

6. The method of claim 5, wherein the one or more defined protocols include at least one standard protocol defined as: Society of Automotive Engineers (SAE) J1850 pulse-width modulation (PWM) standard protocol; SAE J1850 variable pulse width (VPW); International Organization for Standardization (ISO) 9141-2; ISO 14230 Keyword Protocol 2000 (KWP2000); and, ISO 15765 Controller Area Network (CAN) bus.

7. The method of claim 3, wherein the vehicle further comprises a vehicle communication system in communication arrangement with the device protocol system using one or more defined protocols.

8. The method of claim 7, wherein the vehicle is an automobile, mobile transport equipment, industrial equipment, medical device, or device having a communication system, engine control unit (ECU) to provide data across a communication protocol.

9. The method of claim 8, wherein the network ID is one or more of a mobile identification network (MIN) identifier, an Internet Protocol (IP) v4 address, an IPv6 address, a device IP address, an address of a user, an address of a vehicle manufacturer, and an address of a storage device.

10. The method of claim 9, wherein the service broker system is on the remote network and the remote network is a cloud.

11. The method of claim 10, wherein the transmitted at least one message further includes one or more of proprietary data, a codec, service data, command data, and parameter data.

12. The method of claim 11, wherein the data store is located at an address on the remote network associated with the network ID.

13. The method of claim 12, wherein the step of decoding further includes encoding whereby the communication between the device protocol system and the service broker system is bilateral.

14. The method of claim 9, wherein the service broker system is capable of decoding the transmitted at least one message.

15. The method of claim 14, further comprising the step of communicating with one or more of a vehicle manufacturer, codec data store, or proprietary command data store to obtain one or more associated formats, commands, codes, codecs, and proprietary translations for decoding or encoding.

16. The method of claim 8, wherein the at least one message further comprises a header having one or more of the network ID, the device ID, and a session ID for identifying a communication session of the message.

17. The method of claim 7, the network ID is a destination identifier associated with any of a network, user, manufacturer, mobile application, device, or other addressable node of the remote network; and the device ID is an originating source identifier of the vehicle data.

18. An apparatus for communicating and storing vehicle information from a vehicle across a remote network to one or more remote devices utilizing at least one communication protocol of the vehicle, comprising:

a device protocol system capable of communications with a remote service broker system and a vehicle, the device protocol system having:

a protocol adapter for communicating with a vehicle communication system of the vehicle across one or more defined protocols and receiving vehicle data, and a device controller for communicating received vehicle data and one or more network storage addresses with a service broker system across the remote network, the service broker system having:

a broker network module for receiving and sending one or more messages with one or more of the device controller, a device maker, a vehicle manufacturer, a vehicle assignee, a data store, and a mobile application; a decoder for decoding received vehicle data from the device protocol system; and an access control module for providing a data use profile rule set for the vehicle data;

an access control module for providing security, permission and privacy in relation to the obtained or to-be-obtained vehicle data; wherein the access control module includes a data sharing profile which includes identifiable attributes, authentication and authorization rules and duration, to an entity in control of the vehicle to allow for control of how data of the vehicle will be shared;

an application service module for processing requests from applications to access vehicle data; and a communications module for transmitting at least one message having a device ID, a network ID, and the received vehicle data, from the device protocol system across the remote network to a service broker system capable of mapping the device ID to the network ID; wherein the network ID uniquely identifies a communication endpoint in the remote network to the service broker system; whereby the service broker system stores decoded vehicle data to the one or more remote devices across the remote network in relation to the one or more remote network storage addresses.

19. The apparatus of claim 18, wherein the received vehicle data is one or more of diagnostic, operational, performance, proprietary, service, and parameter data.

20. The apparatus of claim 19, wherein the received vehicle data is output data compliant with OBD II.

21. The apparatus of claim 19, wherein the device protocol system and the vehicle communication system are in operational communication.

22. The apparatus of claim 19, wherein the device protocol system further comprises: the vehicle communication system being OBD II standard compliant and the defined protocols being one or more of: Society of Automotive Engineers (SAE) J1850 pulse-width modulation (PWM) standard protocol; SAE J1850 variable pulse width (VPW); International Organization for Standardization (ISO) 9141-2; ISO 14230 Keyword Protocol 2000 (KWP2000); and, ISO 15765 Controller Area Network (CAN) bus.

23. The apparatus of claim 18, wherein the network ID uniquely identifies the communications module transmitting or receiving the at least one message.

24. The apparatus of claim 18, wherein the transmitting of at least one message is performed over one or more communication technologies of: Code division multiple access (CDMA), Global System for Mobile Communications (GSM), Universal Mobile Telecommunications System (UMTS), Long Term Evolution (LTE), 4G LTE, wireless local area network (WIFI), and one or more wired networks.

25. The apparatus of claim 24, wherein the at least one message contains a header, service data and proprietary data.

26. The apparatus of claim 25, wherein the header includes the network ID, and the service data includes the vehicle data, and the proprietary data includes proprietary data formats and commands for the service broker system.

27. The apparatus of claim 26, wherein the header further includes the device ID.

28. The apparatus of claim 24, wherein the service broker system further provides for mapping of the device ID and the network ID to one or more addresses on the remote network, decoding the at least one message from the device protocol system, sending at least one or message to and from the device controller, and querying and receiving information with the mobile application.

29. The apparatus of claim 28, wherein the service broker system further includes: a device profile module for storing the mapping of the device ID and the network ID to one or more addresses on the remote network, whereby a device ID includes at least one endpoint ID; a data store being at least one of the one or more remote devices for storing received vehicle data; and, an applications service module for processing requests from software applications to access vehicle data.

30. The apparatus of claim 29, wherein the service broker system is on the remote network and the remote network is a cloud.

31. The apparatus of claim 30, wherein the vehicle is an automobile, mobile transport equipment, industrial equipment, medical device, or device having a communication system with a compliant communication protocol.

32. The apparatus of claim 30, wherein the device controller comprises a circuit controller board and the device adapter comprises a microcontroller capable of interfacing with a defined protocol.

33. The apparatus of claim 32, wherein the defined protocol is CAN bus or based on a CAN bus standard.

34. A computer program product stored on a non-transitory computer usable medium, comprising: computer readable program means for causing a computer to control an execution of an application to perform a method for communicating and storing vehicle information from a vehicle across a remote network to one or more remote devices utilizing at least one communication protocol of the vehicle, comprising:

receiving vehicle data from the vehicle through a device protocol system in communication arrangement with the vehicle;

providing security, permission and privacy in relation to the vehicle data;

processing requests from applications to access the vehicle data;

providing a data sharing profile which includes identifiable attributes, authentication and authorization rules and duration, to an entity in control of the vehicle to allow for control of how data of the vehicle will be shared;

transmitting at least one message having a device ID, a network ID, and the received vehicle data, from the device protocol system across the remote network to a service broker system capable of mapping the device ID to the network ID; wherein the network ID uniquely identifies a communication endpoint in the remote network; and decoding and storing the vehicle information of the at least one transmitted message on the remote network at a data store in relation to the transmitted at least one message.

35. The non-transitory program product of claim 34, wherein the device protocol system further comprises: the vehicle communication system being OBD II standard compliant and the defined protocols being one or more of: Society of Automotive Engineers (SAE) J1850 pulse-width modulation (PWM) standard protocol; SAE J1850 variable pulse width (VPW); International Organization for Standardization (ISO) 9141-2; ISO 14230 Keyword Protocol 2000 (KWP2000); and, ISO 15765 Controller Area Network (CAN) bus.

36. The non-transitory program product of claim 35, wherein the transmitting of at least one message is performed over one or more communication technologies of: Code division multiple access (CDMA), Global System for Mobile Communications (GSM), Universal Mobile Telecommunications System (UMTS), Long Term Evolution (LTE), 4G LTE, wireless local area network (WIFI), and one or more wired networks.

37. The non-transitory program product of claim 36, wherein the remote network includes the Internet.

38. The non-transitory program product of claim 37, wherein the vehicle data is one or more of diagnostic, operational, performance, proprietary, service, and parameter data.

39. The non-transitory program product of claim 38, wherein the product is one of software, web-based application, or firmware.

* * * * *